United States Patent [19]

Soileau

[11] 3,953,978

[45] May 4, 1976

[54] COMBINED DRAIN AND FLOOD GATE

[76] Inventor: Hosea J. Soileau, 614 N. Coreil St., Ville Platte, La. 70586

[22] Filed: Mar. 10, 1975

[21] Appl. No.: 556,865

[52] U.S. Cl. ..... 61/28; 61/29
[51] Int. Cl.[2] ..... E02B 7/20
[58] Field of Search ..... 61/29, 28, 18, 16, 22

[56] References Cited

UNITED STATES PATENTS

| | | | |
|---|---|---|---|
| 1,594,204 | 7/1926 | Kingham | 61/29 X |
| 1,771,112 | 7/1930 | Dorazio | 61/29 |
| 2,056,679 | 10/1936 | Lehman | 61/29 |
| 2,725,720 | 12/1955 | Lough | 61/29 |
| 2,958,200 | 11/1960 | Russell | 61/16 |
| 3,287,918 | 11/1966 | Stewart | 61/29 X |

FOREIGN PATENTS OR APPLICATIONS

| | | | |
|---|---|---|---|
| 210,645 | 3/1956 | Australia | 61/28 |

*Primary Examiner*—Jacob Shapiro
*Attorney, Agent, or Firm*—Clarence A. O'Brien; Harvey B. Jacobson

[57] ABSTRACT

A combined drain and flood gate employed in irrigation and flood control systems and installed in a levee, bank, dam or the like separating two adjacent land areas for controlling water flow from one area to the other to maintain one area at a predetermined flood level or to completely drain one area into the other. The gate includes a vertically movable panel forming a gate in a spillway or passageway and a drain gate which can be opened and is at a lower level than the vertically movable gate for completely draining water from one area into another.

8 Claims, 4 Drawing Figures

COMBINED DRAIN AND FLOOD GATE

BACKGROUND OF THE INVENTION

1. Field of the Invention

The present invention generally relates to a combined flood and drain gate employed in connection with irrigation, drainage or flood control systems for controlling flow of water from one area to an adjacent area with the device including a vertically adjustable flood gate and an openable drain gate associated with a levee, dam or bank which separates one area from the other.

2. Description of the Prior Art

Water level control devices used in irrigation and drainage systems are generally well known with various prior patents disclosing such arrangements. My prior U.S. Pat. Nos. 3,701,260, issued Oct. 31, 1972 and 3,803,851, issued Apr. 16, 1974 and the prior art cited therein illustrate devices generally for this purpose. While such devices are effective for their purposes, they generally do not employ separate gates for flood control and drainage.

SUMMARY OF THE INVENTION

An object of the present invention is to provide a combined flood gate and drain gate in which the flood gate is independently adjustable and the drain gate independently openable to enable depth control of water flooding a particular land area and, when desired, enabling the land area to be completely drained which conditions are necessary when growing certain crops during various stages of the growing season. One such crop in which such control is desirable is the growing of rice plants which require flooding to a certain depth during certain stages of the growing cycle with the land area being subsequently drained during other portions of the growing season and during the harvesting season.

Another object of the invention is to provide a combined flood and drain gate in which the flood gate is vertically adjustably mounted in a passageway or spillway formed in a horizontally elongated and vertically disposed mounting structure.

A further object of the invention is to provide a flood and drain gate in accordance with the preceding objects in which the flood gate is provided with an erosion shield extending from the downstream side of the flood gate to protect adjacent land surface areas from erosion by water passing over the flood gate.

Still another object of the invention is to provide a flood and drain gate in which the drain gate is oriented at a level below the flood gate to completely drain an upper level surface area so that any water flooding such area will be discharged to a surface area at a lower level.

Another important feature of the present invention is the provision of a combined flood and drain gate constructed of plastic material of sufficient strength and rigidity and which is relatively long lasting, simple to install and easy to operate.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
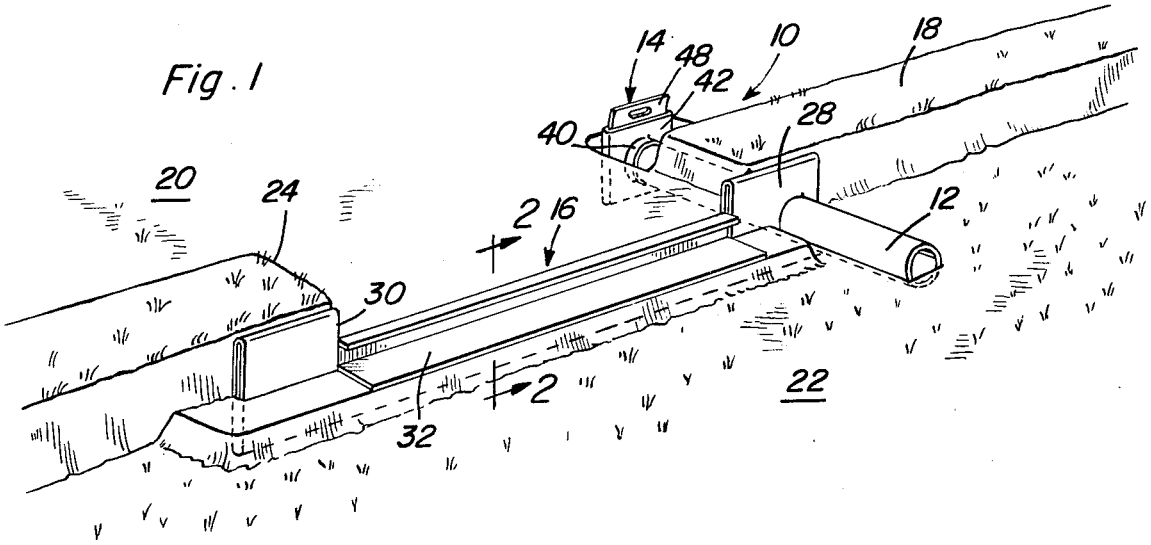
FIG. 1 is a perspective view of the combined flood gate and drain gate of the present invention illustrating the device installed in a levee, dam or bank separating two adjacent land areas at different elevational levels.
Figure 2:
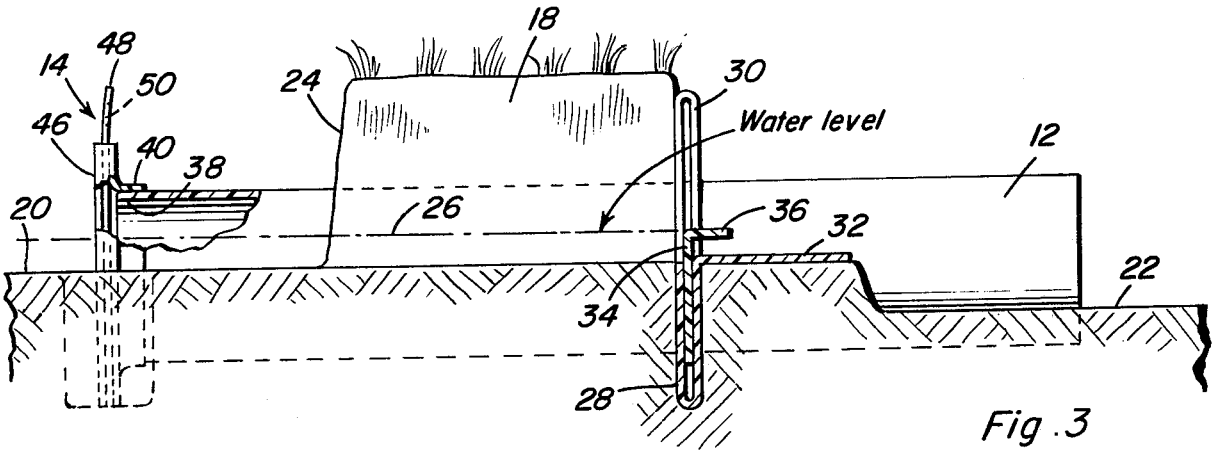
FIG. 2 is a vertical, sectional view taken substantially upon a plane passing along section line 2—2 of FIG. 1 illustrating further structural details of the gate.
Figure 3:
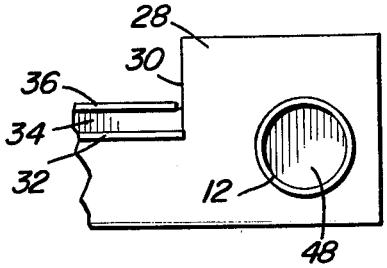
FIG. 3 is a fragmental elevational view of the discharge end of the drain gate.

The combination flood and drain gate of the present invention is generally designated by reference numeral 10 and includes a drain pipe or tube 12 having a drain gate generally designated by numeral 14 on one end thereof and a flood gate generally designated by numeral 16 extending laterally therefrom with the entire assembly being incorporated into a upwardly projecting levee, dam or bank 18 which separates land areas 20 and 22 from each other in which the land area 20 is substantially flat as is the land area 22 with the land area 20 being at a predetermined elevation above the land area 22 as illustrated in FIG. 2. When installed, the drain pipe 12 extends through the levee 18 with the drain gate 14 on the upstream side thereof and the flood gate 16 is associated with a passageway or spillway defined by numeral 24 and which is of a predetermined length and communicates the land area 20 with the land area 22 so that water 26 may be maintained at a predetermined level over the area 20 with any excess water draining over the flood gate 16 to the lower area 22 and when it is desired to completely drain the area 20, the drain gate 14 is opened thus completely draining water from the upper area 20 to the lower area 22.

The flood gate 16 includes an elongated generally rectangular, vertically disposed member which may be conveniently formed by utilizing a length of plastic pipe which has been flattened to form a rectangular member having adjacent parallel walls which are interconnected at their top and bottom edges. A horizontally elongated, vertically disposed notch or recess 30 is formed in the member 28 by making two vertical cuts in the member 28 and one of the walls so cut is folded downwardly to generally a horizontal position to form an erosion shield 32 which is disposed on the downstream side of the flood gate 16 so that any water passing through the notch or spillway 30 which is aligned with the passageway or spillway 24 in the levee 18 will impinge upon the erosion shield 32 so that the soil underlying the shield 32 and engaging the member 28 will not be eroded due to water spilling over the flood gate.

Positioned in the notch 30 is an elongated panel 34 which is in the form of a gate and which has its bottom edge and end edges slidably positioned between the two walls of the member 28 so that the upper edge of the gate 34 may be vertically adjusted to control the water level of the water 26 which floods the area 20. Thus, by manually adjusting the vertical position of the plate or gate 34 in relation to the supporting member 28, the depth of water may be adjusted. This enables the flooded depth of water in the area 20 to be manually controlled and adjusted when desired. To rigidify, reinforce and provide a handle for the gate 34, the upper edge thereof is formed at a 90° bend to form a flange 36 which retains the plate 34 in substantially straight and rigid condition and also provides a handle throughout the length of the plate 34 which is disposed between the side edges of the notch 30 so that the vertical movement of the plate 34 can be readily performed. The plastic construction of the plate 34 and the member 28 provides frictional locking engagement for the plate 34 so that it will maintain itself in vertically adjusted position.

With the flood gate 16 installed so that the edges of the notch 30 generally correspond with the passageway 24 and with the end portions of the supporting member 28 embedded in the ground surface either in the levee 18 or at the downstream edge thereof, the passageway 24 and notch 30 define a spillway for waer passing from the upper area to the lower area. The flange 36 is oriented downstream so that water passing thereover will discharge onto the erosion shield 32 with the soil being built up under the erosion shield 32 or, if desired, the erosion shield 32 may be lower than the bottom edge of the notch 30.

Figure 4:
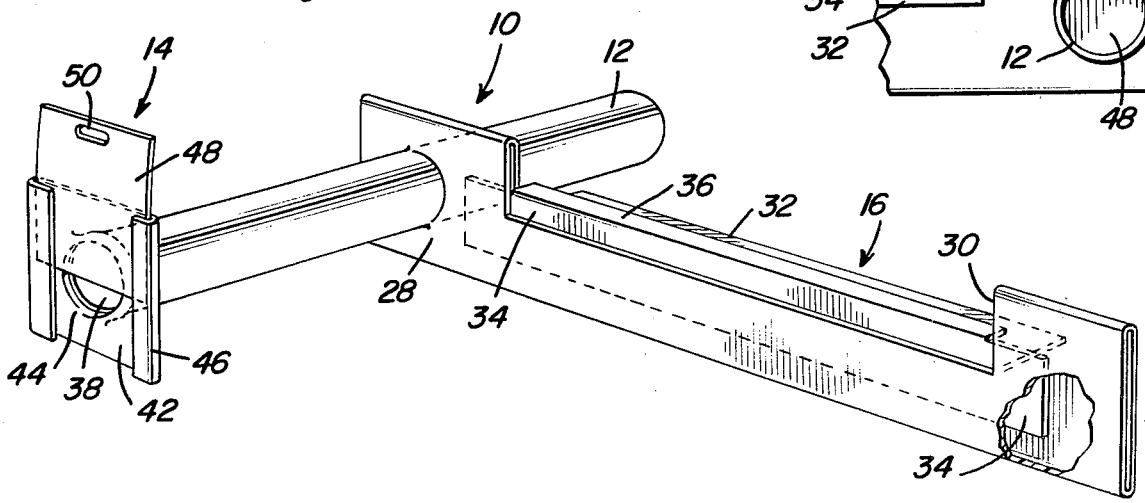
FIG. 4 is a perspective view of the flood and drain gate.

The drain pipe 12 extends through an end portion of the supporting member 28 and may be rigidly affixed thereto or may be slidably received therein so that the relative position of the pipe 12 and the drain gate on the upstream end thereof may be properly oriented in relation to the levee 18, that is, with the drain gate adjacent thereto. The pipe 12 is of cylindrical construction and includes a beveled end 38 telescoped into a flange 40 on a vertically disposed plate 42. The upright plate 42 includes an enlarged opening 44 defined by the flange 40. The upright plate also includes parallel inturned side edge flanges 46 which define vertical parallel guides. The flange 40 and the opening 44 in the plate 42 are generally centrally located in the plate with the inner edges of the inturned side edge flanges being substantially in tangential aligned relation to opposite sides of the cylindrical flange 40 or opening 44. Slidably received in the guides is a valve panel 48 which is generally rectangular and includes parallel side edges slidably received in the guides for selectively closing the opening 44. The valve panel 48 is bowed from top to bottom, as illustrated in FIGS. 2 and 4, for frictionally engaging the guides and the surface of the plate 42 above and below the opening to retain the valve panel 48 in vertically adjusted position. The valve panel is only slightly longer than the guides and is provided with straight top and bottom edges and is imperforate except for an oval-shaped hand hole 50 which defines a handle for the panel 48. This structure maintains a constant perimeter and a thickness of minimum dimensions with the hand hole being disposed closely adjacent the top edge of the plate 42 when the bottom edge of the valve panel 48 engages the surface of the plate below the opening. The plate 42 and the flange 40 as well as the inturned flanges 46 are of one piece construction with the inturned flanges or guides 46 as well as the flange 40 serving to rigidify the plate 42. The frictional detachable connection between the pipe 12 and the plate 42 enables the drain gate 14 to be removed when desired such as when harvesting a crop, cultivating the field prior to planting and the like.

The entire device is constructed of plastic material such as polyvinyl chloride pipe and panels which may be reinforced with glass fiber reinforcing material and such material is commercially available and employed in constructing pipe. While the dimensions of the device may vary, to meet field conditions, the drain pipe which may be a standard 10 inch diameter pipe is oriented so that the bottom edge thereof is approximately 6 inches below the adjustable flood gate when at its lower level and the flood gate itself may be adjustable approximately 6 inches. The drain pipe may vary in length but usually is approximately 4 feet long while the notch 30 in the flood gate may be approximately 5 feet long with the overall length of the support member 28 being approximately 8 feet in length. The member 28 may conveniently be formed by flattening a length of pipe of 12 inch diameter so that as a result, the member 28 is approximately 19 inches in height with the erosion shield being a width approximating 9 inches. Thus, standard components may be used in constructing the device with the thermoplastic material of the pipes enabling the flattening thereof and assembly of the drain pipe with the support member 28 at the site of installation.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A flood gate for use in combination with a levee separating an upper land surface area from an adjacent lower land surface area for controlling flow of water from the upper area to the lower area, said flood gate comprising a vertically disposed, elongated support member extending across an opening in the levee and forming a closure therefor to prevent water flow through the levee, said support member including a recess in the top edge thereof defining a passageway for passage of water from the upper area to the lower area, and a vertically movable panel mounted on the support member and extending throughout the length of the recess for forming a vertically movable closure for the recess for controlling the level of water retained in the upper area thereby maintaining a desired depth of water in covering relation to the upper land area, and controllable drainpipe means extending through the levee and one end portion of the support member for complete drainage of water from the upper area to the lower area.

2. The structure as defined in claim 1 wherein said support member includes a laterally extending horizontal flange generally coinciding with the lower edge of the recess and extending toward the lower area whereby water flowing over the top edge of the panel will impinge upon the flange so that adjacent land areas will not be eroded by such water flow.

3. The structure as defined in claim 1 wherein said support member includes two vertical, side-by-side walls of flattened pipe, said panel having the end edges and the bottom edge thereof slidably and frictionally disposed between the two walls defining the support member for frictionally retaining the panel in vertical adjusted position.

4. A flood gate for use in combination with a levee separating an upper land surface area from an adjacent lower land surface area for controlling flow of water from the upper area to the lower area, said flood gate comprising a vertically disposed, elongated support member extending across an opening in the levee and forming a closure therefor to prevent water flow through the levee, said support member including a recess in the top edge thereof defining a passageway for passage of water from the upper area to the lower area, and a vertically movable panel mounted on the support member and extending throughout the length of the recess for forming a vertically movable closure for the recess for controlling the level of water retained in the upper area thereby maintaining a desired depth of water in covering relation to the upper land area, and controllable drainpipe means extending through the levee and one end portion of the support member for complete drainage of water from the upper area to the lower area, together with a drainpipe extending through the levee and one end portion of the support member, the lower portion of the drainpipe being disposed below the top edge of the recess in the support member and being below the upper land surface area for complete drainage of water from the upper area to the lower area, and a drain gate on the end of the pipe adjacent the levee in overlying relation to the upper land surface area.

5. The structure as defined in claim 4 wherein said drain gate includes an upright plate having an opening therein communicated with the drain pipe, said plate having inturned side edges defining guides, a valve panel slidably received in said guides for selectively closing said opening in the plate.

6. The structure as defined in claim 5 wherein said plate includes a relatively short cylindrical flange defining the opening, said drain pipe having a beveled end telescopically and removably connected to the flange on the plate, sad valve panel being bowed from top to bottom for frictionally engaging said guides and the surfaces of the plate above and below the opening to retain the valve panel in vertically adjusted position, said valve panel including a hand hole adjacent the upper edge thereof forming a handle for manipulating the valve panel.

7. The structure as defined in claim 6 wherein said support member includes a laterally extending flange generally coinciding with the lower edge of the recess and extending toward the lower area whereby water flowing over the top edge of the panel will impinge upon the flange so that adjacent land areas will not be eroded by such water flow, said support member including two vertical, side-by-side walls formed by flattening a cylindrical pipe into a rectangular member, said panel having the end edges and the bottom edge thereof slidably and frictionally disposed between the two walls defining the support member for frictionally retaining the panel in vertical adjusted position, said panel including a laterally extending flange along its top edge to define a handle manipulating the panel vertically and a reinforcement for retaining the panel in straight condition.

8. In combination with a water retaining levee delineating a plant growing area to be maintained with a predetermined depth of water thereover while the plants are growing and drained during harvesting of the crop, a flood gate combined with a control device comprising a cylindrical pipe extending through the levee for discharge of water from the area, a water gate detachably mounted on the upstream end of the pipe outwardly of the levee, said water gate including a plate oriented generally in an upright position and provided with an enlarged opening defined by a short cylindrical peripheral flange telescopically and removably connected to the end of the pipe, said plate including parallel inturned side edge flanges defining vertical parallel guides, said cylindrical flange and opening defined thereby being centrally located in the plate, the inner edges of the inturned side edge flanges being substantially in tangential aligned relation to opposite sides of the cylindrical flange, and a valve panel having straight, parallel side edges slidably received in said guides for selectively closing said opening in the plate, said valve panel being bowed from top to bottom for frictionally engaging said guides and the surfaces of the plate above and below the opening to retain the valve panel in vertically adjusted position, said valve panel being only slightly longer than the guides and provided with straight top and bottom edges and being imperforate except for a hand hole adjacent the top edge defining a handle for the panel while maintaining a constant perimeter and thickness of minimum dimensions, said hand hole being disposed closely adjacent the top edge of the plate when the bottom edge of the valve panel engages the surface of the plate below the opening, the upstream end of said pipe being beveled from the exterior toward the interior to telescope into the flange on the plate, said plate, flange and guides being of one-piece construction with the guides and flange rigidifying said plate, said panel being of one-piece construction with all of said components being constructed of glass fiber reinforced resin plastic material, said flange on the plate including a cylindrical interior surface, said beveled end of the pipe being frictionally and detachably connected with the flange to enable the removal of the water gate when harvesting thereby preventing damage thereto by contact of farm implements therewith, and to prevent damage thereto by cattle or other animals when the area is being used as pasture land during normal crop rotation of the plant growing area.

* * * * *